United States Patent [19]

Day

[11] Patent Number: 4,898,556

[45] Date of Patent: Feb. 6, 1990

[54] ELECTRON GUN INTEGRAL BEAM CORRECTORS AND METHOD

[75] Inventor: James C. Day, Owensboro, Ky.

[73] Assignee: North American Philips Consumer Electronics Corp., New York, N.Y.

[21] Appl. No.: 274,694

[22] Filed: Nov. 14, 1988

Related U.S. Application Data

[60] Continuation of Ser. No. 732,951, May 13, 1985, abandoned, which is a division of Ser. No. 518,507, Jul. 29, 1983, Pat. No. 4,584,500.

[51] Int. Cl.[4] ..... H01J 29/02; H01J 9/14

[52] U.S. Cl. ..... 445/36; 445/49; 313/414

[58] Field of Search ..... 445/36, 49, 50; 313/414

[56] References Cited

U.S. PATENT DOCUMENTS

| | | | |
|---|---|---|---|
| 3,949,262 | 4/1976 | Ohkoshi | 313/414 |
| 4,251,747 | 2/1981 | Burdick | 313/414 |
| 4,275,332 | 6/1981 | Ashizaki | 313/414 |
| 4,412,149 | 10/1983 | Say | 313/414 |
| 4,427,397 | 1/1984 | Endo | 445/49 |
| 4,481,003 | 11/1984 | Yabe | 445/49 |

FOREIGN PATENT DOCUMENTS

| | | | |
|---|---|---|---|
| 0152459 | 11/1979 | Japan | 445/36 |

*Primary Examiner*—Kurt Rowan
*Attorney, Agent, or Firm*—John C. Fox

[57] ABSTRACT

In-line electron gun structure for color cathode ray tubes in which the final focusing and accelerating electrodes each employ three in-line tapered, partially overlapping apertures in facing relationship, and at least one pair of integral electron beam correctors associated with the central aperture of the focusing electrode. Such structure is produced by deep drawing a workpiece having an hour-glass shaped hole for each corrector pair desired.

3 Claims, 3 Drawing Sheets

ELECTRON GUN INTEGRAL BEAM CORRECTORS AND METHOD

This is a continuation of application Ser. No. 732,951, filed May 13, 1985, now abandoned, which is a division of application Ser. No. 518,507, filed July 29, 1983 now U.S. Pat. No. 4,584,500.

CROSS-REFERENCE TO RELATED APPLICATIONS

U.S. patent application Ser. No. 463,791, filed Feb. 4, 1983, a continuation-in-part of Ser. No. 450,574, filed Dec. 16, 1982, now abandoned, describes and claims color cathode ray tube electrodes having tapered apertures. U.S. patent applications Ser. No. 484,780, filed Apr. 14, 1983, and Ser. No. 490,639, filed May 2, 1983, describe and claim improvements to such electrodes relating to beam spot shaping. These applications are assigned to the assignee of the present invention.

BACKGROUND OF THE INVENTION

This invention relates to an in-line electron gun structure for color cathode ray tubes (CCRTs), in which integral beam correctors are incorporated into one or more of the electrode apertures of the final focusing and accelerating electrode lenses, and more particularly relates to such structures in which the apertures are tapered.

Reducing the diameter of the necks of CCRTs can lead to cost savings for the television set maker and user in enabling smaller beam deflection yokes and consequent smaller power requirements. However, reducing neck diameter while maintaining or even increasing beam deflection angle and display screen area severely taxes the performance limits of the electron gun.

In the conventional in-line electron gun design, an electron optical system is formed by applying critically determined voltages to each of a series of spatially positioned apertured electrodes. Each electrode has at least one planar apertured surface oriented normal to the tube's long or Z axis, and contains three side-by-side or "in-line" circular straight-through apertures. The apertures of adjacent electrodes are aligned to allow passage of the three (red, blue, and green) electron beams through the gun.

As the gun is made smaller to fit in the so-called "mini-neck" tube, the apertures are also made smaller and the focusing or lensing aberrations of the apertures are increased, thus degrading the quality of the resultant picture on the display screen.

Various design approaches have been taken to attempt to increase the effective apertures of the gun electrodes. For example, U.S. Pat. No. 4,275,332, and U.S. patent application Ser. No. 303,751, filed Sept. 21, 1981 and assigned to the present assignee, describe overlapping lens structures. U.S. patent application Ser. No. 463,791, filed Feb. 4, 1983 and assigned to the present assignee, describes a "conical field focus" or CFF lens arrangement. Each of these designs is intended to increase effective apertures in the main lensing electrodes and thus to maintain or even improve gun performance in the new "mini-neck" tubes.

In the CFF arrangement, the electrode apertures have the shapes of truncated cones or hemispheres, and thus each aperture has a small opening and a related larger opening. In a preferred embodiment, the apertures are positioned so that the larger openings overlap.

This overlapping eliminates portions of the sidewalls between adjacent apertures, leaving an arcuate "saddle" between these apertures.

Regardless of their complex shapes, CFF electrodes may be produced by deep drawing techniques, offering a marked cost advantage over other complex designs. However, in forming the CFF electrodes by drawing for mass production quantities, it has been discovered that the edge of the saddle between adjacent apertures becomes rounded, resulting in a slight decrease in the wall area between the apertures. Unfortunately, such a slight modification to the electrode is sufficient to distort the lensing field, and result in an out-of-round spot for the central electron beam on the display screen.

OBJECTS AND SUMMARY OF THE INVENTION

It is an object of the present invention to provide a modified electron gun structure with overlapping tapered apertures, which modified structure will compensate for the distortion in the lensing field caused by rounded saddles.

It is another object of the invention to provide an electron gun structure in which integral electron beam correctors are incorporated into one or more of the electrode apertures of the final focusing and accelerating electrode lenses.

It is another object of the invention to provide a method for producing integral beam correctors in such electron gun structures.

In accordance with the invention, a lensing arrangement in the final low voltage (focusing) and high voltage (accelerating) lensing electrodes of an in-line electron gun for a CCRT is provided with integral electron beam spot-shaping portions (herein "beam correctors"), to compensate for distortions in the lensing field. These beam correctors are extensions of the sidewalls of the electrode apertures.

Also in accordance with the invention, the lensing electrodes with beam correctors may be produced by a method in which (a) in-line holes are made in a workpiece of formable electrode material, the holes for which beam correctors are desired having a constricted central portion, and being approximately hour-glass shaped; and (b) the workpiece is formed into a three-dimensioned electrode structure in which predetermined portions of the material surrounding the holes is formed into aperture sidewalls, whereby the aperture sidewalls formed from the hour-glass shaped holes have integral extensions which function as beam correctors.

In a preferred embodiment, the beam correctors are formed in the forward portion of the focusing electrode and the rear portion of the accelerating electrode, which are in adjacent, facing relationship, each defining three tapered in-line apertures, a central aperture and two side apertures. The apertures are of 3-dimensional surface of revolution (herein "volumetric configuration") which is substantially truncated, for example, a truncated cone or hemisphere, the axes of symmetry of which are parallel to one another and to the associated path of the electron beam. Each aperture has a large opening in an outer aperture plane of the electrode and a smaller opening in the interior of the electrode, the openings being separated by sloping sidewalls. The apertures are preferably partially overlapping, resulting in a portion of the sidewall of each aperture intersecting a portion of the sidewall of an adjacent aperture to form an inwardly-sloping arcuate rounded saddle along the region of intersection. The resulting structure is derived from the partial overlapping of geometric constructions of the volumetric configurations.

In order to compensate for the lensing field distortion caused by the rounded saddles, the structure also includes at least one pair of integral electron beam correctors located in mirrored, facing relationship in the region of the smaller-dimensioned opening of the central aperture of at least one of the lensing electrodes, the correctors being extensions of the sidewalls of the aperture.

In the presently most preferred embodiment, a pair of correctors is located in the focusing electrode in the central aperture, as rounded tabular extensions of the aperture sidewall, intersecting and symmetrical with the in-line plane of the electron gun. The correctors preferably have the same curvature as the rear opening.

In accordance with the invention, there may also be a pair of correctors as extensions of each of the side apertures, located above and below the in-line plane and symmetrical with it.

DESCRIPTION OF THE PREFERRED EMBODIMENTS

Figure 1:
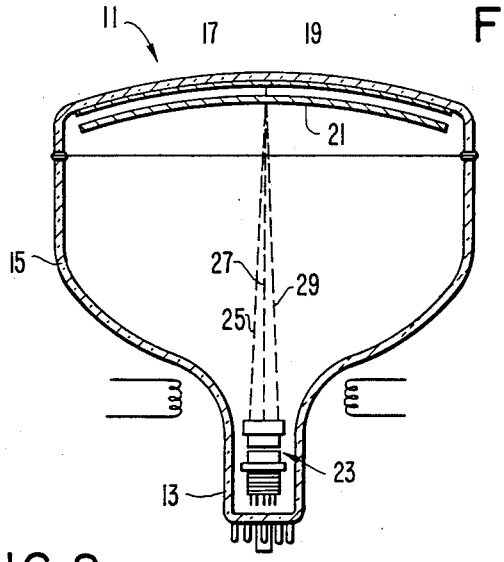
FIG. 1 is a sectioned elevation view of a color cathode ray tube wherein the invention is employed.

With reference to FIG. 1 of the drawings, there is shown a color cathode ray tube (CCRT) 11 of the type employing a plural beam in-line electron gun assembly. The envelope enclosure is comprised of an integration of neck 13, funnel 15 and face panel 17 portions. Disposed on the interior surface of the face panel is a patterned cathodoluminescent screen 19 formed as a repetitive array of color-emitting phosphor components in keeping with the state of the art. A multi-opening structure 21, such as a shadow mask, is positioned within the face panel, spaced from the patterned screen.

Encompassed within the envelope neck portion 13 is a unitized plural beam in-line electron gun assembly 23, comprised of an integration of three side-by-side gun structures. Emanating therefrom are three separate electron beams 25, 27, and 29 which are directed to pass through mask 21 and land upon screen 19. It is within this electron gun assembly 23 that the structure of the invention resides.

Figure 2:
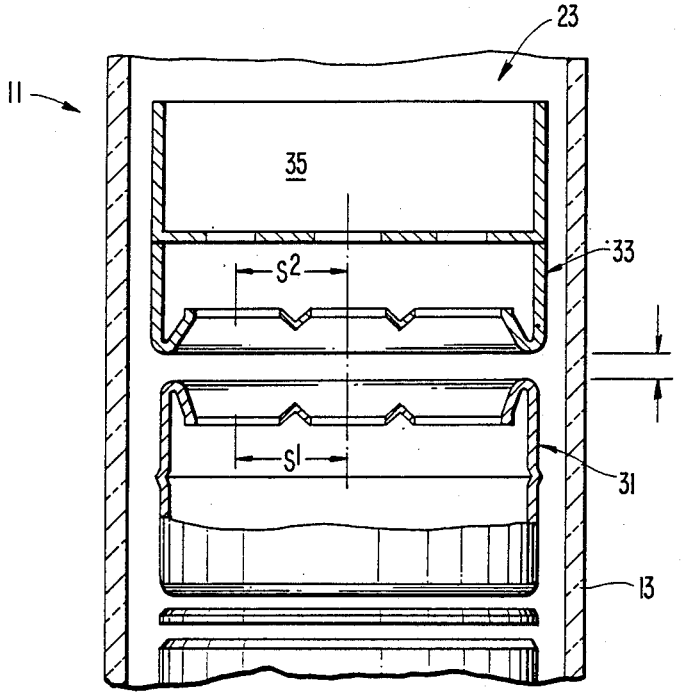
FIG. 2 is a sectioned elevation view of the forward portion of the in-line plural beam electron gun assembly shown in FIG. 1, such view being taken along the in-line plane thereof.

Referring now to FIG. 2, the forward portion of the electron gun 23 of FIG. 1 is shown, including a low potential electrode 31, a high potential electrode 33, and a convergence cup 35. Electrode 31 is the final focusing electrode of the gun structure, and electrode 33 is the final accelerating electrode.

In a "Uni-Bi" gun typically used in mini-neck CCRTs, the main focusing electrode potential is typically 25 to 35 percent of the final accelerating electrode potential, the inter-electrode spacing is typically about 0.040 inches, the angle of taper of the apertures is about 60° with respect to the tube axis, and the aperture diameters (smaller and larger dimensioned openings) are 0.140 and 0.220 inches for the focusing electrode and 0.150 and 0.250 inches for the accelerating electrode. The spacing between aperture centers is 0.177 inch ($S^1$) for the focusing electrode and 0.182 inch ($S^2$) for the accelerating electrode.

Together, these two electrodes form the final lensing fields for the electron beams. This is accomplished by cooperation between their adjacent, facing apertured portions to form lensing regions which extend across the inter-electrode space. The tapered sidewalls of the apertures enable optimum utilization of the available space inside the tube neck 13.

Figure 3:
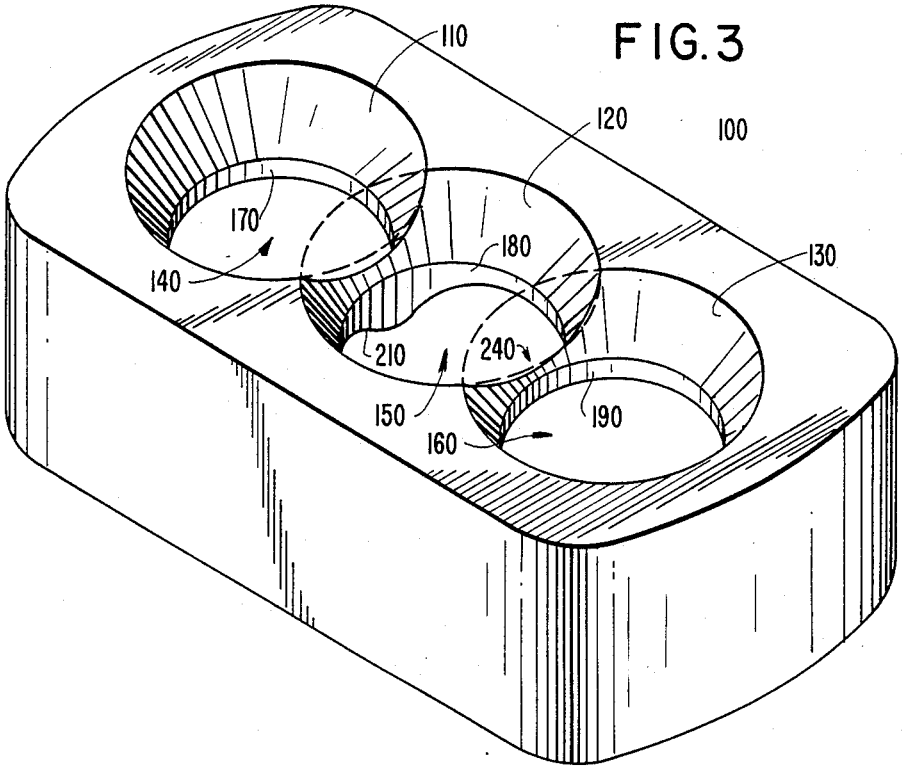
FIG. 3 is a perspective view from above of one embodiment of the unitized low potential lensing electrode of the invention, affording a partial view of the small openings of the apertures and one of the integral beam correctors.
Figure 4:
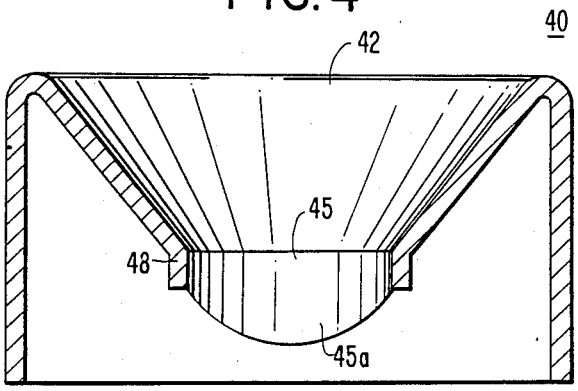
FIG. 4 is a sectioned elevation view of the low potential electrode of FIG. 3, taken along a plane normal to the in-line plane and bisecting the central aperture.
Figure 5:
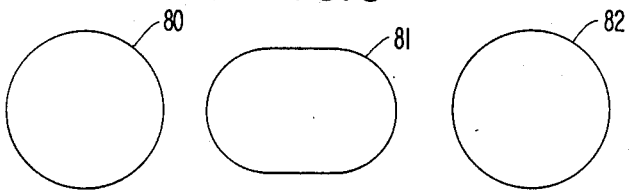
FIG. 5 is a representation of beam spot shapes related to the electron gun of FIG. 2 without beam correctors.

Referring now to FIG. 3, there is shown a focusing electrode 100 of the type shown in FIG. 2, having three in-line apertures with large front beam-exiting openings 110, 120 and 130 substantially in the forward planar surface of the electrode, and smaller rear beam-entering openings 140, 150 and 160 in the interior of the electrode, such openings connected by substantially tapered sidewalls terminating with relatively short cylindrical portions 170, 180 and 190. Geometric constructions of the apertures are truncated cones (ignoring cylindrical portions 170, 180 and 190) which partially overlap one another. This overlap is indicated in phantom in the forward planar surface, and results in the partial removal of sidewall portions of adjacent apertures and the formation of inwardly sloping arcuate edges 230 and 240. In fabrication of such electrode structure by drawing, the edge tends to have a rounded contour forming what is termed herein a "saddle", resulting in reduced sidewall area between apertures and distortion of the lensing field. This field distortion results (for a typical Uni-Bi mini-neck gun as described above) in electron beam spots at the screen as shown in FIG. 5. That is, the central beam spot 81 tends to become compressed vertically and elongated in the direction of the in-line plane of the three beams. Compensation for such distortion is provided herein by integral beam correctors. One of a pair of such beam correctors 210 is seen in FIG. 3. A more detailed view is provided in FIG. 4 which is a section view of the central portion of focusing electrode 100. Corrector **45*a* is an integral extension of cylindrical sidewall 45 and has a curvature conforming to that of rear opening 150. The corrector has a rounded, tabular shape. A similarly shaped corrector extends from the opposite side in facing relationship to corrector 45*a*. Depending upon the degree of field distortion present, and the amount of compensation desired, there may also be provided a similar pair of beam correctors for each of the side apertures 140 and 160**. The corrector pairs for the central aperture lie within the in-line plane and are symmetrical with respect to it. The corrector pairs for the side apertures face the in-line plane, but are also symmetrical with respect to it. A lesser amount of compensation is generally needed for the side aperture-related fields than for the central aperture-related field, which may be achieved simply by smaller side beam correctors.

Figure 6:
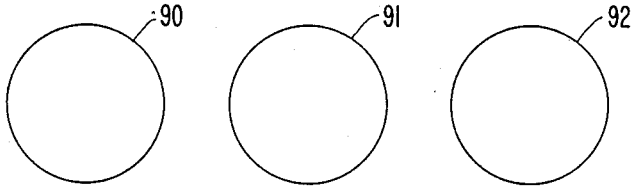
FIG. 6 is a representation of beam spot shapes related to the electron gun of FIG. 2 with beam correctors.

FIG. 6 shows the beam spots after compensation by use of the correctors as described herein.

Figure 7:
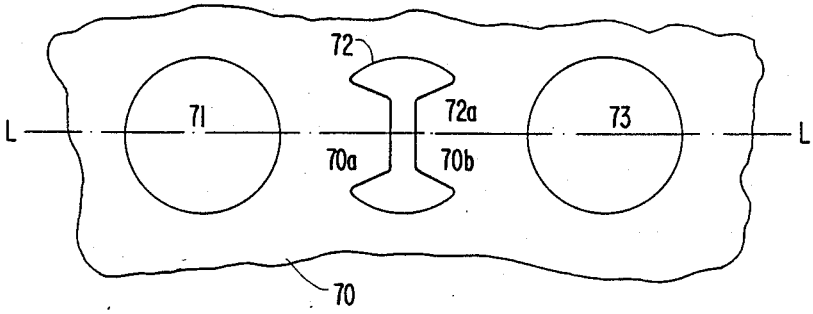
FIG. 7 is a top view of an electrode workpiece ready for forming into an electrode structure of the invention.

Referring now to FIG. 7, there is shown a central portion of a flat workpiece 70 of electrode material, having three in-line holes 71, 72 and 73 formed therein. Central hole 72 has a constricted central portion (hourglass shape), in which the neck portion 72*a* is oriented normal to the in-line plane. When the workpiece 70 is formed, such as by deep drawing, dies having the desired shape force the electrode material surrounding the holes to deform into the sidewall portions defining the apertures. Tabular portions 70*a* and 70*b* of the workpiece become extensions of the central sidewall in this process, forming the desired integral beam correctors.

What is claimed is:

1. A method for producing an in-line electron gun electrode structure for a color cathode ray tube, such lensing structure having a planar surface normal to the in-line plane, and three in-line apertures having axes of symmetry lying in the in-line plane, each aperture having an opening in the planar surface, a terminal opening, a sidewall extending from the planar surface to define the terminal opening, and at least one pair of electron beam correctors extending from and integral with the sidewall defining at least one of the terminal openings, the method comprising:

(a) producing three in-line holes in a workpiece of formable electrode material, at least one of the holes having a constricted central portion with substantially parallel sides; and (b) forming the workpiece into a three-dimensional electrode structure in which predetermined portions of the material surrounding the holes is formed into aperture sidewalls whereby the aperture sidewall associated with the hole having the constricted central portion has integral extensions therefrom, which extensions function as beam correctors.

2. The method of claim 1 wherein the extensions are of rounded tabular shape.

3. The method of claim 1 wherein the workpiece is formed by deep drawing.

* * * * *